United States Patent [19]

Kajino et al.

[11] Patent Number: 4,944,324

[45] Date of Patent: Jul. 31, 1990

[54] FUEL GAS SUPPLY EQUIPMENT WITH ABNORMAL OFFENSIVE ODOR SUPPRESSING FILTER

[75] Inventors: Hideo Kajino, Tokyo; Kazuo Matsuo, Sapporo, both of Japan

[73] Assignees: Iwatani Sangyo Kabushiki Kaisha; Central Sekiyu Gas Kabushiki Kaisha, both of Japan

[21] Appl. No.: 331,973

[22] Filed: Apr. 3, 1989

[30] Foreign Application Priority Data

Aug. 31, 1988 [JP] Japan ..... 63-115454

[51] Int. Cl.[5] ..... F17C 7/02

[52] U.S. Cl. ..... 137/113; 137/550

[58] Field of Search ..... 137/113, 112, 550, 544

[56] References Cited

U.S. PATENT DOCUMENTS

| | | | |
|---|---|---|---|
| 2,156,823 | 5/1939 | Stettner | 137/550 X |
| 2,197,144 | 4/1940 | Carnes | 137/113 X |
| 3,001,541 | 9/1961 | St. Clair | 137/113 |
| 3,033,220 | 5/1962 | St. Clair | 137/113 |

*Primary Examiner*—Alan Cohan

*Attorney, Agent, or Firm*—Lowe, Price, LeBlanc, Becker & Shur

[57] ABSTRACT

In a fuel gas supply equipment with an abnormal offensive odor suppressing filter, there is provided a gas supply passage from a gas outlet of a gas container containing LP gas such as propane gas to a gas inlet of a gas burner. The gas supply passage is provided with a pressure regulating means and a filter mounting portion disposed on the upstream side of the pressure regulating means. A cotton-like filter is inserted into the filter mounting portion. The gas inlet of the filter mounting portion and the gas outlet thereof are intercommunicated through the filter.

11 Claims, 3 Drawing Sheets

FUEL GAS SUPPLY EQUIPMENT WITH ABNORMAL OFFENSIVE ODOR SUPPRESSING FILTER

BACKGROUND OF THE INVENTION

1. Field of the Invention

The present invention relates to fuel gas supply equipment which serves to supply a gas burner with liquefied petroleum gas contained within a gas container and which is provided with a filter for suppressing an abnormal offensive odor of the gas.

2. Background of the Prior Art

Generally, liquefied petroleum gas (simply referred to as LP gas, hereinafter), such as propane gas and the like, is taken out of the gas container through its gas outlet in a gaseous state and then the pressure thereof is reduced to a small pressure of ab. 300 mmAq through a pressure regulating means so that the gas can be supplied to a gas burner such as a portable gas cooking heater or a gas stove.

To LP gas of this kind, there is usually added an extremely small quantity of a smelly agent (for example, an agent of mercaptan series) which gives off an offensive odor, so that a gas leak accident brought about by the fire going-out in the gas burner can be noticed readily. The smelly agent is selected from materials that are harder to gasify than the LP gas in order to remain in the gas throughout the entire period of LP gas supply from the gas container. Thereby, the offensive odor can be noticed when the LP gas leaks into the atmosphere even in the volume ratio of ab.1/1000.

When the gas burner is lighted, a very small quantity of the unburned gas tend to be discharged into the atmosphere between from the opening of a fuel cock to the completion of lighting. Also at the time of extinguishing of the gas burner, a very small quantity of unburned gas remaining in the burner after the closing of the fuel cock tends to be discharged into the atmosphere.

These very small quantities of unburned gases do not give off offensive odors so strong as to hurt somebody's feelings while the liquid portion of the LP gas remains substantially within the gas container, while the liquid portion of the LP gas remains within the gas container, the LP gas and the smelly agent are kept in a proper mixed condition, but, the concentration of the smelly agent mixed with the gas to be supplied to the gas burner is increased abnormally because the concentration of the smelly agent (which is harder to gasify than the LP gas) is increased as the residual liquid portion of the LP gas within gas container is descreased by the consumption thereof.

SUMMARY OF THE INVENTION

A principal object of the present invention is to suppress the emission of the abnormal offensive odor from a very small quantity of gas which leaks at the time of lighting as well as extinguishing of the gas burner.

For accomplishing the above-mentioned object, a preferred embodiment of the invention is characterized in the following construction.

A filter mounting portion is provided on the upstream side of a pressure regulating means, a cotton-like filter is inserted into the filter mounting portion, and the gas inlet of the filter mounting portion and the gas outlet thereof are intercommunicated through the filter.

The preferred embodiment functions as follows.

When the residual liquid portion of the LP gas within the gas container is decreased by continuous consumption and then the residual pressure therewithin is descreased accordingly, the LP gas within the gas container tends to reach a boiling state. But, since the density of the LP gas to be taken out of the gas container reduces as the residual pressure thereof within the gas container is decreased even though the mass flow thereof is constant, the volumetric flow of the LP gas is increased. Accordingly, the flow resistance of the filter is increases so as to suppress the abrupt boiling of the LP gas within the gas container. As a result, the smelly agent in the residual liquid portion of the LP gas attains a misty state so as to mix with the gaseous portion thereof.

Furthermore, in the case that the misty smelly agent mixed with the gaseous portion of the LP gas flows out of the gas container, it is caught by the cotton-like filter so that the quantity thereof flowing to the pressure regulating means and the gas burner can be reduced effectively.

In this way, since the cotton-like filter serves to suppress the mixing of the misty smelly agent with the LP gas and to catch the misty smelly agent flowing out of the gas container, the concentration of the smelly agent in the gas supplied to the gas burner can be prevented from increasing abnormally. Therefore, the very small quantity of gas leaking at the time of lighting or extinguishing of the gas burner can be prevented from giving off the abnormal offensive odor.

Another embodiment of invention is characterized in that the above-mentioned invention is modified as follows.

The the gas container for containing the LP gas comprises a service gas container and a spare gas container with the respective gas outlets the service gas container and of the spare gas container being connected to the gas inlet of a secondary pressure regulator through an automatic changeover type pressure regulator, the automatic changeover type pressure regulator is adapted to allow the gas to be supplied only from the service gas container while the pressure at the service side gas inlet exceeds the predetermined changeover pressure and to allow the gas to be supplied also from the spare gas container in addition to the service gas container when the pressure at the service side gas inlet lowers to the predetermined changeover pressure, and there are provided filter mounting portions and cotton-like filters respectively on the upstream sides of the respective gas inlets of said automatic changeover type pressure regulator.

The second embodiment of the functions as follows.

At the time of the commencement of the LP gas removal from the service gas container, the spare gas container is kept in a fully filled condition.

When the residual liquid portion of the LP gas within the gas container is decreased by a continuous consumption thereof every utilization and then the residual pressure therewithin is decreased accordingly, as in the first embodiment the cotton-like filter reduces the quantity of the misty smelly agent mixing with the LP gas and catches the misty smelly agent flowing out of the gas container.

When the pressure at the service side gas inlet of the automatic changeover type pressure regulator lowers to the predetermined changeover pressure and the quantity of the gas supplied only from the service gas container is reduced the LP gas is adapted to be supplemented from the spare gas container so that a necessary flow of the gas can be covered by the summing up of the flow of gases from both gas containers. During this changeover, since the residual pressure of the gas within the service gas container is increased corresponding to the pressure loss caused in the filter, the concentration of the smelly agent within the service gas container can be kept lower corresponding to the increased portion of the residual gas pressure. The LP gas remaining within the service gas container can be taken out with diluting of the smelly agent by the LP gas from the spare gas container until its residual liquid portion becomes extremely small. In this way, since the LP gas having the smelly agent of which concentration is increased by a decrease of the residual liquid portion of the LP gas within the service gas container can be diluted by the LP gas having the smelly agent of which concentration is low within the spare gas container, an increasing of the concentration of the smelly agent in the LP gas supplied from the automatic changeover type pressure regulator is suppressed effectively.

As noted above, since the cotton-like filter can reduce the quantity of the misty smelly agent mixing with the LP gas, catch the misty smelly agent flowing out of the gas container and dilute the LP gas having the smelly agent of which concentration is high, the concentration of the smelly agent in the LP gas to be supplied is prevented from being increased abnormally and the very small quantity of the gas leaking at the time of lighting or extinguishing of the gas burner does not give off the abnormal offensive odor.

BRIEF DESCRIPTION OF THE DRAWINGS

The invention may be best understood by those having ordinary skill in the art by reference to the following detailed description when considered in conjunction with the accompanying drawings, in which:

FIGS. 1 through 3 show the first embodiment thereof;

FIG. 1 is a diagram showing a system of a fuel gas supply equipment;

FIG. 2 is a view showing a part of a piping of the fuel gas supply equipment;

FIG. 3 is an enlarged vertical sectional view showing a filter mounting portion;

FIGS. 4 through 7 show the second embodiment thereof;

FIG. 4 is a diagram showing a system of a fuel gas supply equipment;

FIG. 5 is a view showing a part of a piping of the fuel gas supply equipment;

FIG. 6 is an enlarged vertical sectional view showing a filter mounting portion;

FIG. 7 is a schematic explanatory view of an operation of an automatic changeover type pressure regulator;

FIG. 7(*a*) is a view showing a condition such that gas is supplied only from a service gas container;

FIG. 7(*b*) is a view showing a condition such that the gas is supplied from both the service gas container and a spare gas container; and FIG. 7(*c*) is a view showing a condition such that the gas supply has been changed over and the empty service gas container has been replaced with a charged one to be used as a next spare gas container.

DESCRIPTION OF THE PREFERRED EMBODIMENTS

The embodiments of the present invention will now be explained with reference to the drawings hereinafter.

FIRST EMBODIMENT

Figure 1:
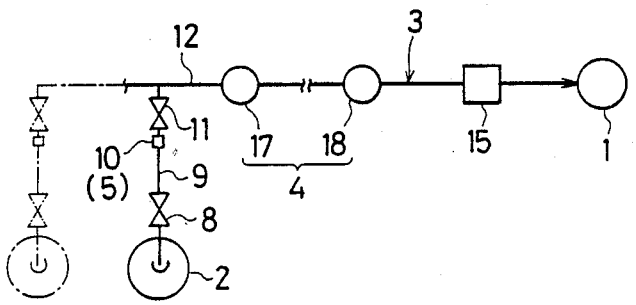
FIGS. 1 through 7 show the embodiments of the present invention.
Figure 2:
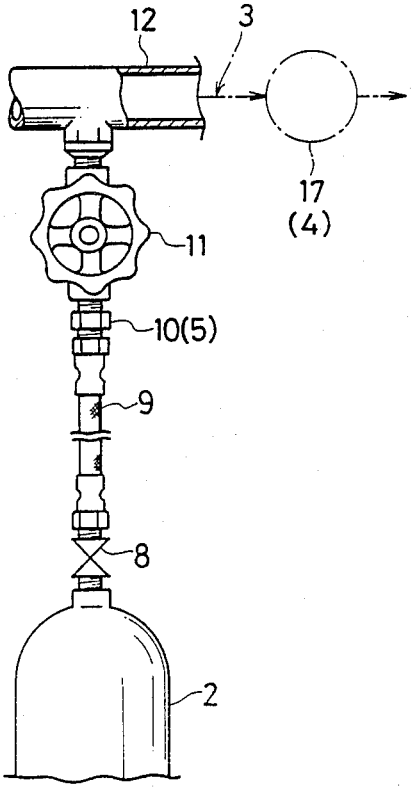
Figure 3:
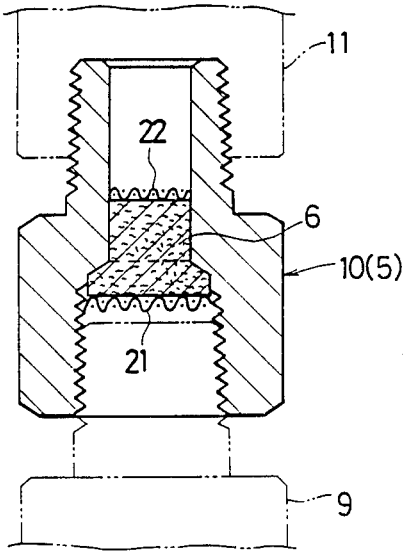

FIGS. 1 through 3 show the first embodiment.

With reference to FIGS. 1 and 2, a fuel gas supply equipment for a gas burner 1 will be explained. The fuel gas supply equipment is provided with a gas container 2 for containing propane gas, a gas supply passage 3, a pressure regulating means 4, a filter mounting portion 5 and a filter 6 (refer to FIG. 3).

The gas supply passage 3 is provided with a gas container valve 8, a high pressure hose 9, a female-male nipple 10, a main valve 11 and a supply pipe 12 arranged in order between the gas outlet of the gas container 2 and the gas inlet of the gas burner 1. The supply pipe 12 is provided in its intermediate portion with the pressure regulating means 4 and a gas meter 15 arranged in order. The pressure regulating means 4 is of a two-stage pressure reduction type and comprises a primary pressure regulator 17 and a secondary pressure regulator 18. The propane gas is adapted to be supplied from the gas container 2 to the gas burner 1 with its pressure being reduced to 0.7 $Kg/cm^2$ through the primary pressure regulator 17 and then further reduced to a very small pressure of 300 mmAq through the secondary pressure regulator 18.

The filter mounting portion 5 is formed in the female-male nipple 10 disposed on the upstream side of the pressure regulating means 4. It will be explained with reference to FIG. 3 as follows.

In this embodiment, the female-male nipple 10 is of $\frac{1}{4}^{B}$ caliber and has an absorbent cotton-like filter 6 inserted in the intermediate portion of its flow passage. The filter 6 is mounted therein so tightly that its packed density becomes 0.7–1.0 $g/cm^3$, and it is retained at its opposed upper and lower ends by a gas inlet side wire-netting 21 and a gas outlet side one 22 respectively. Thereby, the lower gas inlet and the upper gas outlet of the female-male nipple 10 are interconnected through the filter 6.

According to the measurements of a pressure loss during the use of the fuel gas supply equipment having such a construction as mentioned above, the pressure loss caused by the filter 6 was 0.2 $Kg/cm^2$ in the case that the propane gas was supplied at a flow rate of 1 Kg/hr and the pressure at the inlet of the filter 6 was 5.0 $Kg/cm^2$.

Since the filter 6 serves to suppress the entertainment of a misty odorous agent with the LP gas and acts to prevent an abnormal amount of the misty smelly agent flowing out of the gas container 2 while the the liquid portion of the propane gas remains small within the gas container 2, the concentration of the smelly agent in the gas supplied to the gas burner 1 is prevented from being increased abnormally. Therefore, the very small quantity of the gas leaking at the time of lighting or extinguishing of the gas burner 1 is prevented from giving an abnormal offensive odor.

Since the flow of the misty ordorous agent thus not allowed to flow to the pressure regulating means 4 is suppressed and the gas meter 15 disposed on the downstream side, these devices are kept clean and keep satisfactory accuracy.

The pressure regulating means 4 may be of a single-stage pressure reduction type instead of the two-stage pressure reduction type.

Further, a plurality of gas containers 2 may be arranged side by side as indicated by the alternate long and short dash line in FIG. 1.

FIG. 3 illustrates a preferred embodiment in which the filter comprises a plug of cotton-like absorbent material 6 packed into the filter-mounting portion 10 to enable a gas flow therethrough in a linear manner.

SECOND EMBODIMENT

FIGS. 4 through 7 show the second embodiment.

Figure 4:
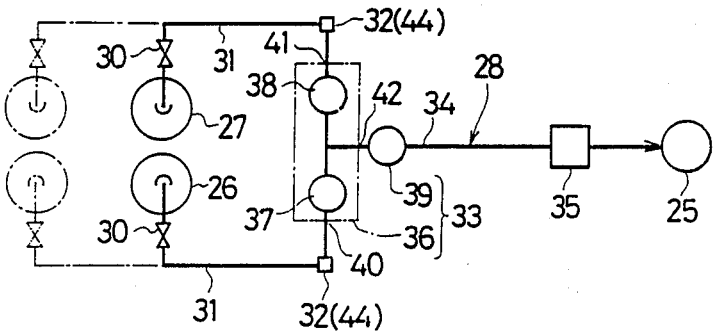
Figure 5:
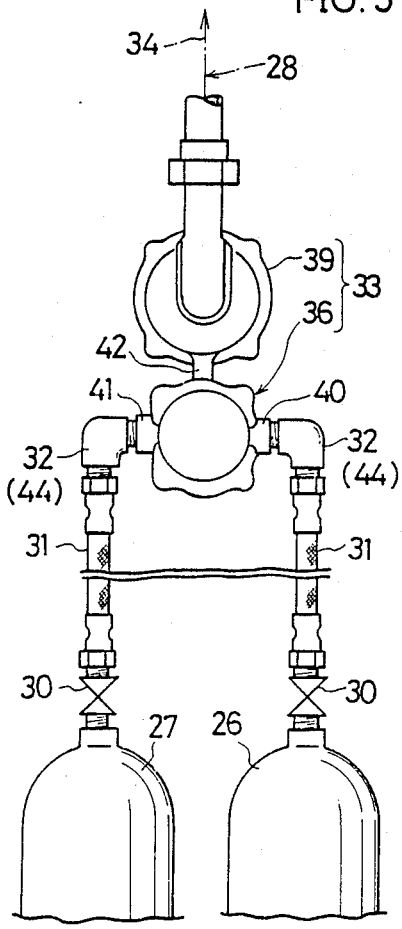

As shown in FIGS. 4 and 5, a gas container for containing propane gas comprises a service gas container 26 and a spare gas container 27. A fuel gas supply equipment is adapted to supply the propane gas automatically from the spare gas container 27 when the propane gas within the service gas container 26 is consumed completely. A gas supply passage 28 is provided with gas container valves 30, 30, high pressure hoses 31, 31, female-male elbows 32, 32, a pressure regulating means 33 and a supply pipe 34 arranged between the outlets of the respective gas container 26, 27 to a gas burner 25. The symbol 35 designates a gas meter.

The pressure regulating means 33 is formed integrally by an automatic changeover type pressure regulator 36 comprising an assembly of two primary pressure regulators 37, 38 similar to the one shown in the above-mentioned first embodiment and a secondary pressure regulator 39 similar to the one shown in the first embodiment.

The automatic changeover type pressure regulator 36 is of a known type and is provided with a service side gas inlet 40, a spare side gas inlet 41 and a pressure reduction side outlet 42. Respectively, the service side gas inlet 40 is connected to the gas outlet of the service gas container 26, the the spare side gas inlet 41 is connected to the gas outlet of the spare gas container 27, and the pressure reduction side gas outlet 42 is connected to the gas inlet of the secondary pressure regulator 39.

The filter mounting portions 44, 44 are formed in the female-male elbows 32, 32 disposed respectively on the upstream side of the service side gas inlet 40 and on the upstream side of the spare side gas inlet 41. These will be explained with reference to FIG. 6 as follows. In this embodiment, the female-male elbow 32 is of $\frac{1}{4}^{B}$ caliber and has an sborbent cotton-like filter 45 inserted in the bent portion of its flow passage. The filter 45 is mounted therein so tightly that its packed density becomes 0.7–1.0 g/cm$^3$, and it is retained at both of its ends by gas inlet side wire-netting 46 and gas outlet side wire-netting 47 respectively. Thereby, the lower gas inlet and the lateral gas outlet of the female-male elbow 32 are interconnected through the filter 45.

Figure 6:
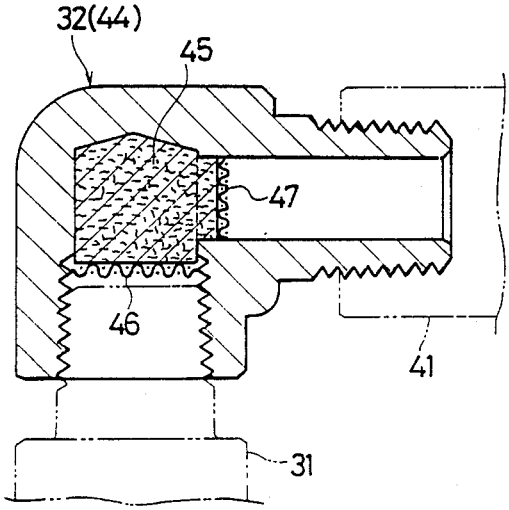

FIG. 6 illustrates a filter plug 45 that causes the gas flow to turn through its passage through the plug volume by about 90° in its passage through elbow 32.

Next, the automatic changeover type pressure regulator 36 will be explained with reference to the explanatory view of FIG. 7 hereinafter.

A set pressure (for example, 0.7 Kg/cm$^2$) at the outlet of the primary pressure regulator 37 disposed on the right service side is selected to be higher than that (for example, 0.4 Kg/cm$^2$) at the outlet of the primary pressure regulator 38 disposed on the left spare side.

Figure 7A:
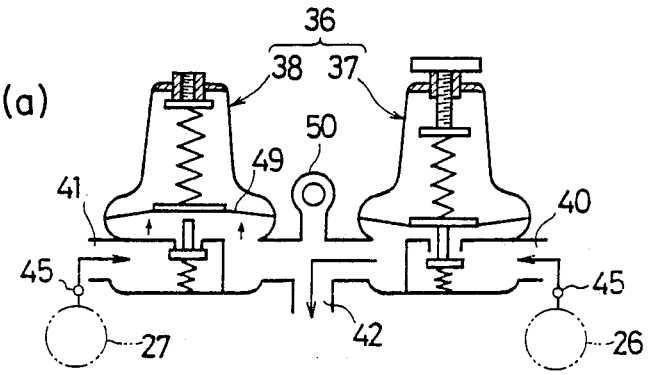
Figure 7B:
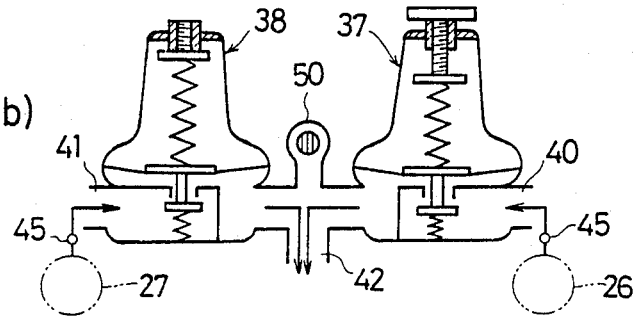
Figure 7C:
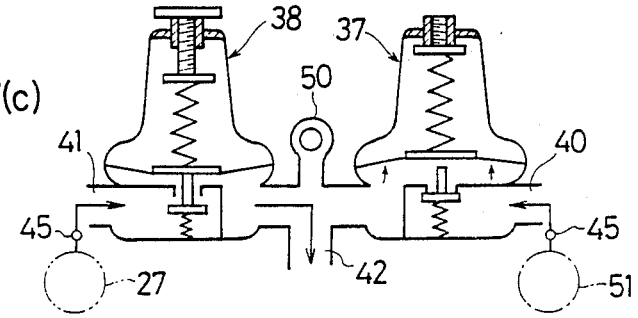

FIG. 7(*a*) shows a condition such that the gas is supplied only from the service gas container 26. In this case, the left side pressure regulator 38 is kept closed by exerting to a diaphragm 49 thereof the pressure at the outlet of the right side pressure regulator 37 which is higher than a closing pressure (in this case, 0.5 Kg/cm$^2$) for the left side pressure regulator 38. Under this condition, the propane gas from the service gas container 26 is directed so as to pass through the filter 45, through the right side pressure regulator 37 with its pressure being reduced to 0.7 Kg/cm$^2$, through the secondary pressure regulator 39 with its pressure being reduced to a very small pressure of 300 mmAq as shown in FIG. 4 and then to be supplied to the gas burner 25.

FIG. 7(*b*) shows a condition in which the gas is supplied from both gas containers 26, 27.

As the residual liquid portion of the gas within the service gas container 26 is decreased by the consumption thereof from the container 26, the residual pressure thereof is lowered. Therewith, while the pressure at the service side gas inlet 40 gets lowered to a predetermined changeover pressure (1.0 Kg/cm$^2$), the pressure at the outlet of the right side pressure regulator 37 gets lowered under the outlet set pressure (in this case, 0.7 Kg/cm$^2$) and further lowered under the closing pressure (0.5 Kg/cm$^2$) for the left side pressure regulator 38. Thereupon, the pressure regulator 38 is opened so that the LP gas can be supplemented from the spare gas container 27 so as to cover the necessary flow thereof summing up the gases supplied from both gas containers 26, 27. Incidentally, this condition is adapted to be detected by an indicator 50. During this changeover, since the residual pressure of the gas within the service gas container 26 is increased corresponding to the pressure loss caused in the filter 45, the concentration of the smelly agent within the service gas container 26 can be kept lower corresponding to the increased portion of the residual gas pressure. The propane gas remaining within the service gas container 26 can thus be taken out with dilution of the odorous agent by the propane gas from the spare gas container 27 until its residual liquid portion becomes extremely small (in this case, until the pressure at the service side gas inlet 40 becomes 0.5 Kg/cm$^2$).

FIG. 7(*c*) shows a condition in which the empty service gas container has been replaced with a charged one to be used as the next spare gas container and the set pressures for both primary pressure regulators 37, 38 have been changed over. In this case, the gas container 27 previously provided for the spare one is used as the service one and the other spare gas container 51 is provided instead of the gas container 26 previously provided for the service one.

According to the above-mentioned construction, since the respective filters 45 serve to suppress the mixing of the misty odorous agent with the propane gas as well as to catch the misty odorous agent flowing out of the gas container and the propane gas having the odorous agent and at a high concentration which can be diluted, the concentration of the odorous agent in the gas supplied to the gas burner 25 can be prevented from increasing abnormally. Likewise, the very small quantity of the gas leaking at the time of lighting or extinguishing of the gas burner 25 can also be prevented from giving off an abnormal offensive odor.

According to the measurement of a pressure loss during use of fuel gas supply equipment having the above-mentioned construction, the pressure loss caused by the filter 45 was 0.3 Kg/cm$^2$ in the case where the propane gas was supplied from the service gas container 26 at a flow rate of 2 Kg/hr and the pressure at the inlet of the filter 45 was 5.0 Kg/cm$^2$.

In the above-mentioned construction, the secondary pressure regulator 39 may be separated off from both the primary pressure regulators 37, 38, and further three pressure regulators 37, 38, 39 may be disposed separately of one another.

Furthermore, in the above-mentioned first embodiment and second embodiment, the following modifications may be adopted.

As the LP gas for a fuel, a butane gas may adopted and also a mixture of these butane and propane may be adopted instead of the propane gas.

Other cotton-like materials may be utilized in the filter for suppressing an abnormal offensive odor. That is, instead of absorbent cotton, the following may be used.

For example, they are cellulose series fibers such as flax fiber, rayon fiber and the like; a natural fiber such as protein fibers of wool, silk and so on; a regenerated fiber, semi-synthetic fiber, synthetic fiber, nonwoven fabric, inorganic fiber comprising materials such as an asbestos fiber, glass fiber, ceramic fiber, metal fiber, carbon fiber and the like.

Also, the wire-nettings at the opposite ends of the filters 6, 45 may be omitted depending on which material or materials are used in forming the filter.

Still other objects and advantages of the present invention will become readily apparent to those skilled in this art from the preceding detailed description, wherein only the preferred embodiments of the invention are illustrated and described, as aforementioned, simply by way of presenting the best modes contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive, the invention being defined solely by the claims appended hereto.

We claim:

1. A gas supply system, having a gas container for containing a liquefied petroleum gas mixed with an odorous substance to facilitate detection of gas leakage, a gas supply passage and a pressure regulating means, the gas supply passage being arranged from a gas outlet of the gas container to a gas inlet of a gas burner and being provided with the pressure regulating means, comprising:

a filter-mounting portion of the gas supply passage disposed on the upstream side of the pressure regulating means; and a cotton-like filter disposed in said filter-mounting portion to suppress an outflow of an abnormal quantity of said odorous substance, a gas inlet of the filter-mounting portion and a gas outlet thereof being intercommunicated through said cotton-like filter.

2. A fuel gas supply system as recited in claim 1, wherein:

said gas container for containing liquefied petroleum gas comprises a service gas container and a spare gas container;

said pressure regulating means comprises an automatic changeover type pressure regulator and a secondary pressure regulator;

said automatic changeover type pressure regulator is provided with a service side gas inlet and a spare side gas inlet and a pressure reduction side gas outlet, the service side gas inlet being connected to the gas output of the service gas container, the spare side gas inlet being connected to the gas outlet of the spare gas container and the pressure reduction side gas outlet being connected to the gas inlet of the secondary pressure regulator respectively;

said automatic changeover type pressure regulator also being adapted to communicate only the service side gas inlet to the pressure reduction side gas outlet under a condition such that the pressure at the service side gas inlet is above a predetermined changeover pressure and, optionally, to also communicate the spare side gas inlet to the pressure reduction side gas outlet in addition to the service side gas inlet when the pressure at the service side gas inlet is lowered to the predetermined changeover pressure; and said filter mounting portions and said filters are provided on the upstream side of the service side gas inlet and on the upstream side of the spare side gas inlet, respectively.

3. A fuel gas supply system as recited in claim 2, wherein:

said filter mounting portion is formed by a pipe fitting disposed in said gas supply passage.

4. A fuel gas supply system as recited in claim 2, wherein:

said filter comprises absorbent cotton material.

5. A fuel gas supply system as recited in claim 1, wherein:

the principal constituent of said liquefied petroleum gas is propane gas.

6. A fuel gas supply system as recited in claim 1, wherein:

said filter comprises a quantity of absorbent cotton-like material mounted in said filter mounting portion packed tightly to a predetermined mass density in the form of a plug having an inlet portion contiguous with an outlet portion, a flow cross-sectional area of the inlet portion being larger than a flow cross-sectional area of the outlet portion, with inlet and outlet wire-netting retaining screens provided at corresponding inlet and outlet ends of said plug.

7. A fuel gas supply system as recited in claim 2, wherein:

said filter comprises a quantity of absorbent cotton-like material mounted in said filter mounting portion packed tightly to a predetermined mass density in the form of a plug having a inlet portion contiguous with an outlet portion, a flow cross-sectional area of the inlet portion being larger than a flow cross-sectional of the outlet portion, with inlet and outlet wire-netting retaining screens provided at corresponding inlet and outlet ends of said plug.

8. A fuel gas supply system as recited in claim 6, wherein:

said filter mounting portion and said plug packed therein are of a shape such that a flow of gas through said plug is substantially linear.

9. A fuel gas supply system as recited in claim 7, wherein:

said filter mounting portion and said plug packed therein are of a shape such that a flow of gas through said plug is substantially linear.

10. A fuel gas supply system as recited in claim 6, wherein:

said filter mounting portion is shaped such that the gas in flowing from said inlet portion of said plug packed therein to said outlet portion of the plug substantially turns through approximately 90°.

11. A fuel supply system as recited in claim 7, wherein:

said filter mounting portion is shaped such that the gas in flowing from said inlet portion of said plug packed therein to said outlet portion of the plug substantially turns through approximately 90°.

* * * * *